US009115898B2

(12) United States Patent
Carlisle

(10) Patent No.: US 9,115,898 B2
(45) Date of Patent: Aug. 25, 2015

(54) FUEL INJECTOR MOUNTING SYSTEM

(75) Inventor: Michael Lawrence Carlisle, Derby (GB)

(73) Assignee: ROLLS-ROYCE PLC, London (GB)

( * ) Notice: Subject to any disclaimer, the term of this patent is extended or adjusted under 35 U.S.C. 154(b) by 1100 days.

(21) Appl. No.: 12/886,661

(22) Filed: Sep. 21, 2010

(65) Prior Publication Data

US 2011/0088408 A1 Apr. 21, 2011

(30) Foreign Application Priority Data

Oct. 16, 2009 (GB) ..... 0918089.4

(51) Int. Cl.
*F23R 3/28* (2006.01)

(52) U.S. Cl.
CPC ..... *F23R 3/283* (2013.01)

(58) Field of Classification Search
CPC ..... F23R 3/283
USPC ..... 60/796, 798, 800, 739, 740
See application file for complete search history.

(56) References Cited

U.S. PATENT DOCUMENTS

| | | | | |
|---|---|---|---|---|
| 3,742,704 | A * | 7/1973 | Adelizzi et al. | 60/796 |
| 4,466,240 | A * | 8/1984 | Miller | 60/796 |
| 5,253,810 | A * | 10/1993 | Maltby et al. | 60/800 |
| 5,475,979 | A * | 12/1995 | Oag et al. | 60/737 |
| 7,370,477 | B2 * | 5/2008 | Roche et al. | 60/798 |
| 8,051,664 | B2 * | 11/2011 | Fish | 60/740 |
| 2006/0277913 | A1 * | 12/2006 | Fish | 60/739 |
| 2007/0084217 | A1 * | 4/2007 | Nicholls | 60/796 |
| 2007/0137218 | A1 | 6/2007 | Prociw et al. | |
| 2007/0151259 | A1 * | 7/2007 | Thornton | 60/800 |
| 2010/0162714 | A1 * | 7/2010 | Rice et al. | 60/748 |

FOREIGN PATENT DOCUMENTS

| | | | |
|---|---|---|---|
| EP | 1593912 | A1 | 11/2005 |
| GB | 208031 | A | 12/1923 |
| GB | 592973 | A | 10/1947 |
| GB | 686382 | A | 1/1953 |

* cited by examiner

*Primary Examiner* — Ted Kim
(74) *Attorney, Agent, or Firm* — Grogan, Tuccillo & Vanderleeden, LLP

(57) ABSTRACT

A system for mounting a fuel injector to an engine casing with an aperture includes a fuel injector having a flange for mounting to the casing at the aperture. The flange allows it to pass through the aperture. An intermediate ring mediates the mounting of the flange to the casing at the aperture. The intermediate ring is inside the casing at the aperture and defines an opening from which the fuel injector extends into the engine with the flange positioned inward of the ring. The flange is dismountably sealed to an inner side of the ring, and the ring is dismountably sealed to an inner side of the casing to mount the fuel injector to the casing. On dismounting the flange from the ring, the fuel injector can be displaced to allow the ring, to be moved away from the aperture. The fuel injector can then be withdrawn.

5 Claims, 1 Drawing Sheet

FUEL INJECTOR MOUNTING SYSTEM

CROSS REFERENCE TO RELATED APPLICATION

This application is entitled to the benefit of British Patent Application No. GB 0918089.4 filed on Oct. 16, 2009.

FIELD OF THE INVENTION

The present invention relates to a system for mounting a fuel injector to a gas turbine engine.

BACKGROUND OF THE INVENTION

Fuel is delivered to the combustion chamber(s) of a gas turbine engine by one or more fuel injectors.

Fuel injectors for aircraft gas turbine engines are often mounted externally of a casing of the combustion chamber at respective apertures through the casing. Each injector has a mounting flange which is sealingly connected to the external surface of the casing with a feed arm and tip of the injector passing through the aperture and the tip engaging into the head of the combustion chamber. Bolts secure the flange via threads in the casing.

However, a problem with this arrangement is that the securing bolts are working against the casing internal pressure. More particularly, the pressure difference across the casing may be in the range from about 35 to 4100 kPa, with the high pressure within the casing forcing the injector flange away from the casing. This can cause air leakage, and hence engine efficiency loss. On the other hand, an advantage of the arrangement is that the injector can be removed on-wing for maintenance or replacement.

An alternative arrangement has the injector flange sealingly connected to the internal surface of the casing. This overcomes the air leakage problem because the sealing arrangement is working with the internal pressure, i.e. the pressure difference across the casing forces the flange toward the casing. However, the internally mounted injector cannot be easily removed as the flange is too large to be withdrawn through the aperture. Thus the injector can only be removed from the inside, which requires a major engine strip, rendering on-wing maintenance or replacement effectively impossible.

Thus there is a need to provide a system for mounting a fuel injector to a gas turbine engine which facilitates on-wing removal of the injector while reducing air leakage.

SUMMARY OF THE INVENTION

Accordingly, a first aspect of the present invention provides a system for mounting a fuel injector to a gas turbine engine, the system having:

an engine casing having an aperture formed therein, a fuel injector having a flange for mounting the fuel injector to the casing at the aperture, the flange being configured to allow it pass through the aperture, and an intermediate ring which mediates the mounting of the flange to the casing at the aperture, the intermediate ring being positioned inside the casing at the aperture and defining an opening from which the fuel injector extends into the engine with the flange positioned inward of the ring;

wherein:

the flange is dismountably sealed to an inner side of the ring, and the ring is dismountably sealed to an inner side of the casing to mount the fuel injector to the casing, and on dismounting the flange from the ring, the fuel injector can be displaced to allow the ring, when dismounted from the casing, to be moved away from the aperture, such that the fuel injector can be withdrawn from the casing through the aperture.

With the exception of fluid (e.g. fuel) flow through the injector, the combination of the flange and ring can close off the aperture. Advantageously, the system combines an internal mounting arrangement for the injector, which can reduce air leakage, with an ability to withdraw the injector through the aperture, which facilitates on-wing removal of the injector.

The system may have any one or, to the extent that they are compatible, any combination of the following optional features.

Typically, the fuel injector is a fuel spray nozzle, such as an air spray nozzle.

The flange may interference fit to the intermediate ring when sealed to the inner side thereof. The intermediate ring may interference fit to the casing when sealed to the inner side thereof.

Typically, the engine casing has a plurality of apertures formed therein, each having a respective fuel injector and intermediate ring.

A further aspect of the invention provides a combination of the engine casing and the intermediate ring(s) of the first aspect.

A further aspect of the invention provides a combination of a fuel injector and an intermediate ring of the first aspect.

DETAILED DESCRIPTION OF THE PREFERRED EMBODIMENTS

Figure 1:
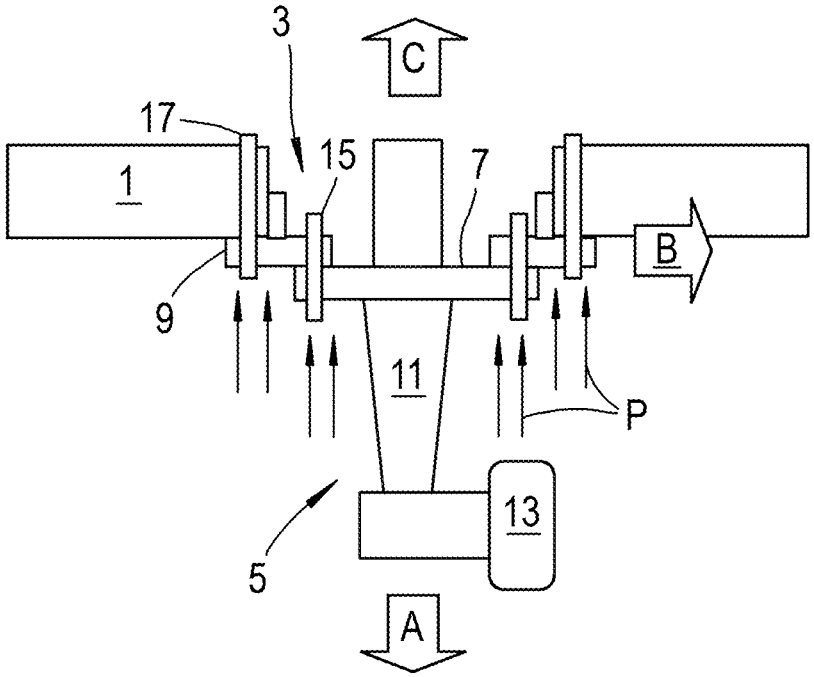
FIG. 1 shows a schematic diagram of a system for mounting a fuel injector to a gas turbine engine according to the present invention.

An engine casing 1 has a plurality of circumferentially spaced, essentially circular apertures 3. Each aperture is the mounting position for a fuel spray injector nozzle 5.

The nozzle 5 has a circular flange 7 whose diameter is less than that of the aperture 3, allowing the flange, and the rest of the nozzle to pass through the aperture.

An intermediate ring 9 is positioned between the flange 7 and the casing 1 to mediate mounting of the flange to the casing. The outer diameter of the ring is greater than the diameter of the aperture 3, while the inner diameter of the ring is less than that of the flange. To mount the nozzle 5 to the casing, the nozzle is positioned within the casing, with the feed arm 11 and tip 13 of the nozzle extending from the opening defined by the ring into the engine so that the tip engages with the head of a combustion chamber (not shown).

A first set of bolts 15 sealingly fasten the flange 7 to an inner side of the intermediate ring 9, and a second set of bolts 17 sealingly fasten the ring to an inner side of the casing 1. Both sets of bolts may employ HeliCoil™ inserts. The heads of both sets of bolts face outwardly, allowing the bolts to be fastened and unfastened from the outside of the casing.

The intermediate ring 9 can be positioned from the inside of the casing 1 on engine build, and can remain in the engine for life, or at least until the engine is stripped at overhaul, where they can be removed from the inside, for example, through the rear of the combustor module once apart from the turbine module.

The numbered arrows A to C indicate the successive operations to remove the nozzle 5 from the outside of the casing 1. Firstly, the bolts 15 holding the nozzle to the intermediate ring 9 are removed, and the nozzle is moved down (arrow A) into the casing. Secondly, the bolts 17 holding the ring to the casing are removed, and the ring moved sideways (arrow B) to clear the aperture 3. Thirdly, the nozzle is withdrawn (arrow C) through the aperture. The procedure allows the nozzle to be removed while the engine remains on-wing. To remount the nozzle to the casing, the sequence of operations is reversed.

Suitably configured tools can facilitate the operations A to C. For example, a nozzle tool can be screwed into an inlet thread of the nozzle 5, allowing the nozzle to be securely held from outside the casing when it is dropped into the engine at A. Likewise, a threaded blind hole in the intermediate ring 9 can allow a similar tool to hold the ring from outside the casing when it is translated at B. Alternatively, one of the bolts 17, in a loosened state, can retain the ring, allowing the ring to rotate about that bolt and away from the aperture 3.

Figure 2:
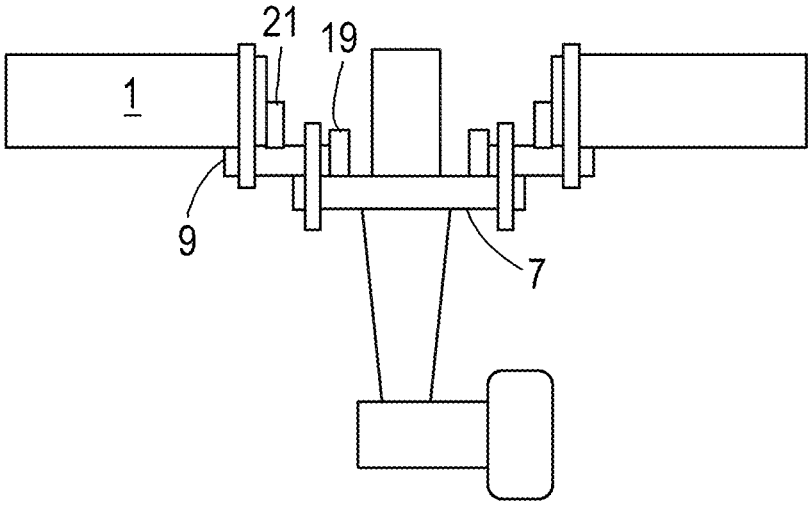
FIG. 2 shows schematically a variant of the system of FIG. 1.

The upwardly pointing arrows P indicate the forces exerted by the pressure differential across the casing 1, and show how the system promotes sealing of the aperture 3 by using an internally mounted flange 7. Grooves can be provided in the flange and the intermediate ring 9 to accept e.g. C-seals to improve sealing of the flange to the ring and the ring to the casing 1. Additionally or alternatively, as shown schematically in FIG. 2, the flange and the ring may have respective shoulder portions 19, 21 which interference fit to respectively the inner face of the opening defined by the ring and the inner face of the aperture. The interference fit could be promoted by freeze fitting, i.e. by cooling the ring and the flange before mounting or dismounting.

The system can significantly reduce leakage flow through the apertures 3, which can benefit engine efficiency, and reduce temperatures outside the casing 1.

The invention claimed is:

1. A system for mounting a fuel injector to a gas turbine engine casing having an aperture formed therein, said system comprising:

a fuel injector having an integral flange for mounting the fuel injector to the casing with the fuel injector extending through the aperture, the flange being configured to pass through the aperture, and an intermediate ring which mediates the mounting of the flange to the casing at the aperture, the intermediate ring being positioned inside the casing at the aperture and defining an opening from which an outer end of the fuel injector extends through the aperture while an inner end of the fuel injector extends into the engine with the flange positioned inward of the ring, the intermediate ring having within the casing an outer diameter greater than that of the aperture in the casing such that the intermediate ring cannot be removed from the engine through the aperture and such that the flange cannot pass through the opening in the intermediate ring;

wherein to mount the fuel injector to the casing the flange is dismountably sealed to an inner surface of the intermediate ring with the fuel injector extending through the opening, and the intermediate ring is dismountably sealed to an inner surface of the casing adjacent the aperture, such that only the fuel injector and the intermediate ring together seal the aperture, and on dismounting the flange from the intermediate ring, the fuel injector can be displaced into the casing to allow the intermediate ring, when dismounted from the casing, to be moved away from the aperture, such that the fuel injector can be withdrawn from the casing through the aperture at which the intermediate ring and flange were sealed.

2. A system according to claim 1 wherein the engine casing has a plurality of apertures, each having a respective fuel injector and intermediate ring.

3. A system as claimed in claim 1, wherein the engine casing comprises a first plurality of through holes surrounding the aperture, the intermediate ring comprises a first plurality of threaded holes in registry with the first plurality of through holes, and a second plurality of through holes radially inward from the first plurality of threaded holes, and the flange comprises a second plurality of threaded holes in registry with the second plurality of through holes.

4. A system as claimed in claim 1, further comprising:

a first plurality of fasteners surrounding the aperture and inserted from an outer surface of the engine casing through the engine casing for dismountably sealing the intermediate ring against an inward surface of the engine casing, and a second plurality of fasteners radially inward from the first plurality of fasteners and inserted from the outer surface of the engine casing through the intermediate ring for dismountably sealing the flange against an inward surface of the intermediate ring.

5. A system as claimed in claim 1, wherein the intermediate ring comprises a first outward-protruding annular shoulder sealing against an inward circumference of the aperture, and the flange comprises a second outward-protruding annular shoulder sealing against an inward circumference of the intermediate ring.

* * * * *